US005367833A

United States Patent [19]

Rhoades et al.

[11] Patent Number: 5,367,833

[45] Date of Patent: Nov. 29, 1994

[54] UNIDIRECTIONAL ABRASIVE FLOW MACHINING

[75] Inventors: Lawrence J. Rhoades, Pittsburgh; Thomas A. Kohut, North Versailles; Nicholas P. Nokovich, Greensburg; Danny W. Yanda, Irwin, all of Pa.

[73] Assignee: Extrude Hone Corporation, Irwin, Pa.

[21] Appl. No.: 139,744

[22] Filed: Oct. 22, 1993

[51] Int. Cl.[5] ..... B24B 19/00

[52] U.S. Cl. ..... 451/104; 451/113; 451/36; 451/132

[58] Field of Search ..... 51/7, 17, 317, 318, 51/292, 2 R, 281 P, 26

[56] References Cited

U.S. PATENT DOCUMENTS 3,699,725 10/1972 Feldcamp ..... 51/317

*Primary Examiner*—Bruce M. Kisliuk
*Assistant Examiner*—Eileen P. Morgan
*Attorney, Agent, or Firm*—Waldron & Associates

[57] ABSTRACT

An abrasive flow machining and polishing apparatus is provided having a hydraulically actuated reciprocating piston (42) and a extrusion medium chamber (10) adapted to receive and extrude a visco-elastic dispersion of an abrasive unidirectionally across the internal surfaces of a workpiece (40) having internal passages (41) formed therein to perform abrasive work on said surfaces. A fixture (24) directs flow of the viscoelastic abrasive dispersion from said hydraulic extrusion medium chamber (10) into the inlet of internal passages (41) in a workpiece (40), while a collector (30) is set to gravitrimetrically collect flow of the viscoelastic abrasive dispersion as it extrudes from an outlet of the internal passages and drops into the collector. The extrusion medium chamber (10) is provided with an access port (16) to periodically receive gravimetric return flow of the viscoelastic abrasive dispersion from the collector (30) into extrusion medium chamber (10). The hydraulically actuated piston (42) intermittently withdraws from its extruding position within said extrusion medium chamber to open the extrusion medium chamber access port (16) and to permit gravimetric return flow of said viscoelastic abrasive dispersion through the opened port (16) and into said extrusion medium chamber(10). When the extrusion medium chamber is charged with the working medium, the operation is resumed in a continuing cyclic fashion until working is completed on the workpiece, whereupon it is replaced with another, and a new cycle is begun.

5 Claims, 2 Drawing Sheets

UNIDIRECTIONAL ABRASIVE FLOW MACHINING

BACKGROUND

TECHNICAL FIELD

The present invention relates to the field of nontraditional machine tools and machining processes, based on the extrusion of a viscoelastic medium containing a dispersed abrasive over the surfaces of a workpiece, particularly the internal surfaces of bores, flow passages, and other internal structures. Such techniques are increasingly used, for example, to polish intake headers, cylinder heads and ports of internal combustion engines to decrease resistance to flow and to attain balanced flow of working fluids to each cylinder.

RELATED CASES

The present invention is related to that disclosed and claimed in U.S. Pat. No. 5,070,652.

PRIOR ART

Abrasive flow machining is a non-traditional machining process whereby a visco-elastic medium, permeated with an abrasive grit, is extruded through or past a workpiece surface to effect an abrasive working of that surface. The abrasive action in abrasive flow machining can be thought of as analogous to a machining, filing, grinding, lapping, polishing or honing operation where the extruded visco-elastic abrasive medium passes through or past the workpiece as a "plug." The plug becomes a self-forming mass, conforming to the surface of the workpiece as it is extruded under pressure through the confined passageway, thereby working the selected surfaces of the workpiece.

While abrasive flow machining is somewhat similar to other abrasion techniques wherein fluids are used as a medium to carry an abrasive grit in dispersion for similar abrasion treatments, (such as hydrodynamic machining) there are considerable differences. In applications where fluids are used; i.e., liquids or gases, very high velocities are essential, not only to maintain the grit particles in dispersion, but because high speed impingement of the grit particles against the surface to be abraded is the essential force in such processes. All such hydrodynamic machining processes are limited by the laws of fluid dynamics and are not, therefore, capable of uniformly machining complex surfaces.

In the present invention, as in other abrasive flow machining processes, however, the visco-elastic abrasive medium is a semi-solid non-Newtoninan fluid extruded through the restrictive passageway under considerable pressure but with a relatively low velocity. The semi-solid viscoelastic medium not only maintains the abrasive particles in a uniform dispersion, it further provides a relatively firm backing under applied shear for the abrasive grit to hold the grit firmly against the passageway surfaces while the semi-solid, visco-elastic medium and grit are extruded through or past the workpiece. Hence, rather than impinging at high speeds against the surface to be abraded, the grit slowly and actively works the workpiece surface with a much higher working force (than a high velocity grit suspended in a fluid carrier) as it forcibly moves along the surface walls to be abraded. Unlike more conventional abrading techniques where the abrasive particles are held against the workpiece by a solid base support, however, the medium supporting the abrasive particles is viscoelastic, so that as a backing material it will conform to the cross-sectional shape of the passageway, turning corners and changing shape as the passageway turns corners and changes shape.

The typical prior art apparatus utilized in abrasive flow machining consists of a structure holding two directly opposed extrusion chambers with the workpiece insertable therebetween. The extrusion chambers are extruding, positive displacement, expandable chambers, having a mechanically driven piston which can extrude the abrading medium from the chamber through the passageway of the workpiece and then into the other extrusion chamber. One or two removable workpiece fixtures, designed to hold the workpiece and seal the workpiece passageway to the extrusion chambers, must be secured between the workpiece and the two extrusion chambers. The workpiece fixture must be designed to securely hold the workpiece such that the workpiece surface to be worked is exposed within the passageway between the two extrusion chambers to permit the abrasive medium to be extruded into and from the workpiece without any leaks. If a surface to be abraded is a bore through the workpiece, the fixture must serve to seal each end of the bore to an extrusion chamber so that the bore itself becomes a sealed passageway between one extrusion chamber and the other. On the other hand, if the workpiece surface to be abraded is an external surface, the fixture is usually more complex and must be designed so that the workpiece and fixture together define the essential restricted passageway so that the surface to be abraded forms a portion of the passageway, and the medium will abrade at least that surface as it is extruded through the passageway.

Some of the earlier techniques for abrasive flow machining were unidirectional processes which utilized one extrusion chamber from which the abrasive medium was extruded through an inlet fixture and through the workpiece passageway and then allowed to fall onto the machine table or into a container upon exiting the workpiece. At some point in time it became necessary to reload the extrusion chamber with the abrasive medium collected. Because of the extra effort and time involved in transferring the medium back into the extruding chamber, this unidirectional technique of extruding the abrasive medium back and forth through one or more workpieces (as described above) thereby eliminating the need to manually reload the medium chamber and significantly shortening the overall processing time.

At the start of a cycle of operation, the extruding medium consisting of a semisolid, flowable, visco-elastic material permeated with an abrasive grit, is contained in one of the extrusion chambers, while the other chamber is empty or near empty. To perform the process, the abrasive medium is extruded, hydraulically or mechanically, from the filled chamber to the empty chamber via the restricted passageway through or past the workpiece surface to be abraded, thereby working the surface as desired. Typically, the extruding medium is then extruded bidirectionally back and forth between the two extrusion chambers to the extent necessary to effect the degree of abrasion desired. Counterbores, recessed areas, and even blind cavities can be abraded by using restrictors or mandrils to direct and guide the abrasive medium flow along the surfaces to be abraded. A more detailed description of the basic prior art on abrasive flow machining can be found in U.S. Pat. Nos. 3,521,412, McCarty; 3,634,973, McCarty; 3,802,128, Minear, Jr.; and 3,819,343, Rhoades.

PROBLEMS IN THE ART

While the prior art techniques are very effective, they do have their limitations with regard to certain workpiece characteristics. Related U.S. Pat. No. 5,070,652 is the closest prior art to that of the present invention, and exhibits limitations that the present invention overcomes. For example, some workpieces have complex geometries which make it difficult to design or apply fixtures that will effectively seal the opening to a passageway to be machined. As examples of such workpieces, some of the more advanced cylinder heads for internal combustion engines incorporating multiple intake and/or exhaust valves per cylinder are very difficult to fixture on both the manifold side and the piston cylinder side of the ports. In efforts to polish such intake or exhaust ports within such cylinder heads utilizing abrasive flow machining, it has been relatively easy to attach a fixture to the manifold side of the ports because the outer openings of the ports are usually located on a flat surface to which the intake or exhaust manifold will eventually be attached. The other ends of the ports, however, are not very easy to seal with a fixture because the port openings are normally very closely spaced with complex geometries within a domed or hemispherical cylinder head, which is further complicated by the fact that the dome will also contain a spark plug opening. While suitable fixtures can of course be designed, they are rather expensive to produce, and set-up time to properly mount the cylinder head workpiece to such fixtures can be rather time consuming if a seal adequate to prevent flow of the medium into areas such as exhaust ports and spark plug ports is to be achieved. In addition, reverse flow through such inlet ports does not work particularly well in most cases since the passageways are tapered.

Another considerable disadvantage of such a technique resides in the fact that the processing of the workpiece often must be done in a single charge of a displacement extrusion medium chamber (which requires exceptionally large extrusion medium chambers and media volumes for complex parts) or the fixturing must be removed and then replaced between machine cycles (introducing extra labor requirements, delay and the opportunity for errors).

In our prior patent, U.S. Pat. No. 5,070,652, unidirectional flow is achieved by collecting media in a extrusion medium chamber in "standby" mode while work is being performed by a companion extrusion medium chamber in "working" mode. When the charge of the working medium is expended in the working extrusion medium chamber, the standby extrusion medium chamber will be recharged, at which point, the roles of the two companion extrusion medium chambers is reversed.

In operation, the two extrusion medium chambers may be alternated in a continuous cycle between the two modes of action until the working of the workpiece is completed. The workpiece is then removed, another is mounted, and the process resumes.

The requirement of two extrusion medium chambers, with their associated hydraulically driven pistons, only one of which is performing useful work at any point in the operating cycle, represents an excessive equipment cost which is unacceptable in many situations.

OBJECTS OF THE INVENTION

It is an object of the present invention to provide simplified and less costly equipment for unidirectional abrasive flow machining, grinding, deburring, radiussing and polishing of internal bores, flow pathways and the like formed internally in workpieces.

Another object of the present invention is to provide such unidirectional abrasive flow machining and the like which is rapid and facile.

These and other objects, as will become apparent, are provided by the invention set out in the following specification:

SUMMARY OF THE INVENTION

An abrasive flow machining and polishing apparatus is provided having a hydraulically actuated reciprocating piston and a extrusion medium chamber adapted to receive and extrude a viscoelestic dispersion of an abrasive unidirectionally across the internal surfaces of a workpiece having internal passages formed therein to perform abrasive work on said surfaces.

A fixture directs flow of the viscoelastic abrasive medium from said extrusion chamber into the inlet of internal passages in a workpiece, while a collector is set to gravimetrically collect flow of the viscoelastic abrasive dispersion as it extrudes from an outlet of the internal passages and drops into the collector.

The extrusion medium chamber is provided with an access port to receive gravimetric return flow of the viscoelastic abrasive dispersion from the collector into extrusion medium chamber.

The hydraulically actuated piston intermittently withdraws from its extruding position within said extrusion medium chamber to open the extrusion medium chamber access port and to permit gravimetric return flow of said viscoelastic abrasive dispersion through the opened port and into said extrusion medium chamber. The reduced pressure created in the chamber as the piston is withdrawn will often assist the gravity flow of the medium into the chamber and accelerate the filling process.

When the extrusion medium chamber is charged with the working medium, the piston is then advanced into engagement in the chamber, sealing the medium in the chamber, ready for another extrusion cycle. The operation is resumed in a continuing, cyclic fashion until working is completed on the workpiece, whereupon it is replaced with another, and a new cycle is begun.

The process can be performed with one or more extrusion medium chambers. A single extrusion medium chamber embodiment is highly desirable when short production runs are to be employed, to keep the equipment costs low. When desired, two or more extrusion medium chambers can be employed, with one receiving the flow of the working medium while the other is working without the requirement of removing the fixturing from the workpiece or from the operating stream of the abrasive medium.

DETAILED DESCRIPTION

Figure 1:
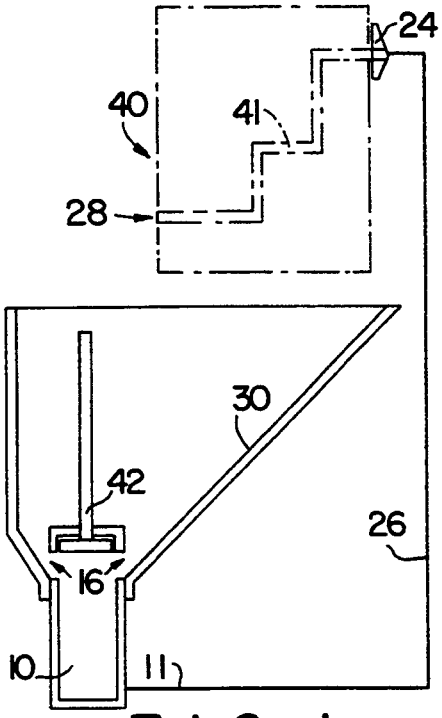
FIG. 1 is a cross section schematic view of the apparatus of the present invention.

The performance of abrasive flow machining, grinding and polishing is highly desirable in a number of contexts, particularly those where the fixtures required for reciprocal extrusion of the medium is impractical because of the complexity of the parts to be worked or the configuration of the openings through which the medium must pass. In other contexts, bi-direction, reciprocal extrusion may be too expensive, such as short production runs. The equipment required may be too expensive and complex for some circumstances.

We have developed effective and efficient uni-directional abrasive flow machining in our prior work, embodied in U.S. Pat. No. 5,0070,652. There remains a need for simpler equipment and operations, however.

In the present invention, we have developed a simpler, less expensive, yet equally reliable and convenient system for the performance of unidirectional abrasive flow machining, grinding and polishing, and with a minimum of tooling and fixture requirements. The system is based on the use of at least one extrusion chamber, driven by a piston and actuating hydraulic extrusion medium chamber or comparable drive mechanism. The extrusion chamber is refilled by gravity flow of the abrasive medium while the chamber is off-line.

Such a simplification is made possible by a gravimetric refeed of the extruded abrasive medium employed in the process, falling from the outlet opening in a workpiece into a hopper, where it flows controllably and intermittently through a extrusion medium chamber access port into the extrusion chamber. The refeed is governed by the operation of the driving piston, which intermittently withdraws from extruding position within said extrusion medium chamber to a retracted position to open said extrusion medium chamber access port and to actuate said gravimetric return flow of the viscoelastic abrasive dispersion into said extrusion medium chamber.

The chamber porting is in direct communication with the interior of the hopper, in which the abrasive medium collects, and is normally closed off by the piston. When the piston is retracted, the ports open into the interior of the extrusion chamber to permit the medium to flow into and fill the chamber to prepare for a resumption of the working operation.

In the preferred embodiment, the extrusion chamber is a vertically oriented extrusion medium chamber, having plural ports disposed in an annular array through the upper end of the extrusion medium chamber side wall, and a working outlet at the bottom of the extrusion medium chamber. In the preferred embodiment, the piston is driven from above.

It is also possible, in a variation on the preferred embodiment to have the extrusion medium chamber open at the top, and to provide a port through the face of the piston. Such a port requires a separate valve means (18) to close off the port.

If desired, the vertically disposed piston can be driven upwardly from below, with both the working outlet and the ports located at the top. Such an arrangement requires that the withdrawal of the piston opens a valve (18) closing off the ports for the refeed flow, which may be slide valves, check valves, or the like.

Comparable to the preferred embodiment is a horizontally disposed and driven cylindrical extrusion chamber, with the hopper communicating with a port disposed in the upper face of the extrusion medium chamber wall. The port is preferably opened by retraction of the piston into the head of the extrusion medium chamber. The working outlet is disposed at the opposite end of the extrusion medium chamber from the port.

It is characteristic of the preferred viscoelastic media employed in the present invention that they exhibit non-Newtonian flow properties. Under shear, as during the extrusion and abrasive flow machining operation, these materials exhibit plug flow through the passages, exhibiting a significant apparent increase in viscosity as shear is applied. When the applied shear is removed, the material upon relaxation exhibits lower viscosity, and more fluid behavior. In particular, it will readily flow under the influence of gravity, so that the material collected in the bottom of the hopper will rapidly flow into and fill the extrusion chamber when the refeed ports are opened by withdrawing the piston from the chamber. Withdrawing the piston also pulls a vacuum within the chamber which operates to pull the medium into the chamber as the ports open. Once the chamber is filled with the medium, the piston advaces into the chamber, closing the ports, sealing the medium in the chamber, and the system is then ready for another extrusion cycle, driven by the farther advance of the piston into the chamber.

The preferred media for use in the present invention are polyborosiloxanes, which may be plasticized, usually with silicone fluids, to a suitable low shear viscosity. The medium is filled with an appropriate charge of an abrasive, selected in relation to the material of and operations to be conducted on the workpiece, in the usual fashion known in the art. Abrasives such as silica, alumina, carborundum, garnet, tungsten carbide, silicon carbide, diamond, walnut shells, and the like may be employed.

Figure 2:
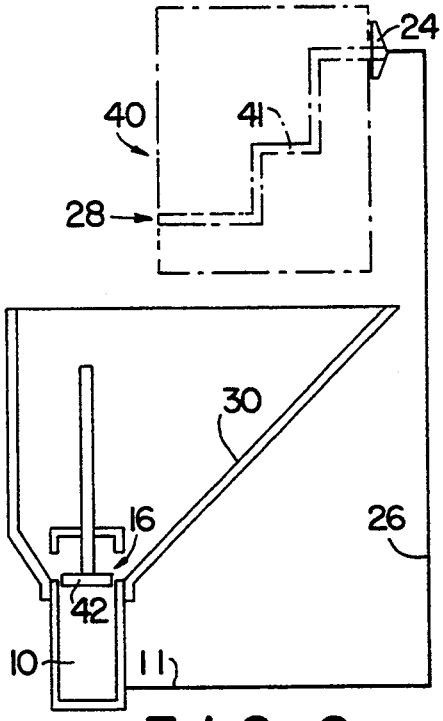
FIG. 2 is a schematic cross section of the embodiment of FIG. 1, in a different stage of operation.

Reference to FIGS. 1 and 1*a* will illustrate one embodiment of this invention as utilized to abrade and polish the intake ports of cylinder heads for internal combustion engines. As shown in FIG. 1 and 2, the apparatus comprises an extrusion chamber (10) adapted to sequentially process a series of workpieces; i.e., internal combustion engine cylinder heads.

Reference to FIG. 1 and 2 illustrate the details of the system where an extrusion chambers (10) is positioned below a workpiece (40), which may conveniently be mounted on a fixture table, not shown.

With reference to FIG. 1, which illustrates the first stage of the process, workpiece (40), in this case a cylinder head is mounted so that the fixture (24) will be aligned and communicate with the inlets to the passageways within the workpiece to be abraded. The outlet side of the workpiece passageway or passageways (28) to be abraded are disposed over a hopper (30) so that the exiting abrasive medium will fall into the hopper and is collected there to be reintroduced into extrusion chamber (10). In this particular application, the passageways to be machined are typically the intake ports of the cylinder head. Preferably, therefore, the intake manifold side of the cylinder head workpiece (40) is tightly secured to fixture (24).

To commence the first stage of the process, as illustrated in FIG. 1, extrusion chamber (10) contains the abrasive medium which is to be extruded through the workpiece. Thereafter, extrusion chamber (10) is activated to cause piston (42), driven by a hydraulic cylinder or the like, to move downwardly extruding abrasive medium within extrusion extrusion medium chamber (10) through the passageway defined by outlet port opening (11), through conduit (26), to fixture (24) and workpiece passageway (41), whereby the abrasive medium will abrade the interior passageway (41) surfaces of workpiece (40) as desired. Upon exiting from the workpiece (40), the abrasive medium will fall into hopper (30) where the force of gravity will cause it to be collected adjacent to the inlet ports (16) of extrusion chamber (10).

At some point the first stage of the process will be completed, normally when the workpiece (40) has been machined to the extent desired, or when extrusion chamber (10) has extruded all of its charge of the abrasive medium. In the present invention, it is not necessary that the apparatus be designed with sufficient extrusion chamber volume that the abrading action on each workpiece will be completed during each cycle of the process. Unlike the prior art, it is no longer important that as so each extrusion stroke of piston (42) is completed, the finished workpiece be completely worked and removed and replaced by a fresh, unworked workpiece, as multiple cycles can be employed without any change in the fixturing and tooling employed in the operation. Multiple cycles permit the effective employment of smaller equipment, at considerable cost savings.

When the first stage of the work cycle is completed, either by completion of the work required on workpiece (40), or by reaching the end of the displacement stroke of piston (42), the second stage, that of recharge of the medium into the extrusion chamber is begun. As shown in FIG. 2, piston (42) is retracted to a position to open charging ports (16) located within the bottom of hopper (40), and passing through the walls of the chamber (10). The abrasive medium is allowed to flow under the force of gravity and the vacuum drawn by the retraction of the piston through ports (16), until the extrusion medium chamber is fully charged.

As illustrated in FIG. 2, extrusion extrusion medium chamber (10) is provided with an annular array of ports (16), disposed around the perimeter of the extrusion medium chamber, and passing through the extrusion medium chamber wall. As the piston (42) is retracted upwardly, to the position shown in FIG. 1, the ports (16) are opened to the interior of hopper (30), and the supply of medium which collects in the hopper adjacent the ports.

Once the chamber (10) is charged, piston (42) is advanced downwardly, to a position where the ports (16) are sealed off, and the charged extrusion medium chamber (10) is then ready for an additional cycle.

Thereafter, the first stage is ready to be repeated, either with another, new workpiece or continuing another working cycle with the same workpiece, as required.

It is evident that the apparatus provides for unidirectional flow of the abrasive medium through the interior pathways of the workpiece.

In view of the above description, it is apparent that the receiving port (16) in the extrusion chamber (10) into which the falling abrasive medium must flow must be positioned so that the inlet opening will receive the abrasive medium within hopper (30). Therefore, the opening must communicate with the interior of hopper (30), and should as a practical matter, therefore, be openings through the extrusion chambers in an upper surface to facilitate receipt of the abrasive medium flow to fill the chamber.

As those of ordinary skill in the art will recognize, it is also possible to employ an extrusion chamber with an open top, and with ports through the piston (42), provided with an opening and closing mechanism such as a slide valve, or the like, rather than through the extrusion medium chamber walls of the chamber.

In a like manner, the outlet opening from the workpiece from which the abrasive medium must exit should face downwardly, or at least laterally, so that the fall of the abrasive medium can be controlled to fall into the receiving chamber or hopper means without collecting on the workpiece. In between the inlet opening through which the abrasive medium is extruded and the workpiece outlet from which the abrasive medium must fall, the passageway through which the abrasive medium must pass can take any form or direction dictated by the design of the workpiece.

Obviously, should the abrasive medium exit the workpiece through an upwardly facing port, it would be far more difficult to guide and direct its fall into the appropriate extrusion chamber. If absolutely essential, however, an upwardly facing exit port could be tolerated, provided that suitable dams, guide means, or even a partial outlet fixture is provided to direct the exiting abrasive medium to a point where it will fall into the receiving extrusion chamber.

While the use of a tilting or rotatable table is a very convenient means for mounting the workpiece (40) to the fixture and above the hopper (30), it is apparent that other techniques could be utilized. In some applications, for example, it may indeed be more simple to selectively fixture the workpiece over the appropriate extrusion chamber without the need of any movable hardware. In still other embodiments, the hopper means may in fact consist of a partial outlet fixture which will guide the abrasive medium to a point where it can thereafter flow into the receiving extrusion chamber.

It should be apparent that the process of this invention does not necessarily entail the complete avoidance of any outlet fixturing whatsoever. While most applications of this invention can be achieved without any outlet port, it is recognized that in some instances at least a partial outlet fixture may be necessary, particularly if an exit port from the upper surface of the workpiece cannot be avoided. Even in these situations, however, a complete outlet fixture between the workpiece and receiving extrusion chamber will not be necessary. Any such outlet fixture will be useful only to the extent of guiding the exiting abrasive medium to a point where it can fall into the receiving extrusion chamber pursuant to the practice of this invention, and will not demand the critical sealing required for a reciprocal flow fixture.

While the above described apparatus and process share a number of features with the prior art, there are unique distinctions which offer considerable advantages, particularly with respect to the machining of workpieces which have at least one surface to which it is difficult to attach or seal a fixture. Specifically, permitting fall of the abrasive medium upon its exit from the workpiece will eliminate the need to fixture and seal the outlet side. It should be readily apparent that by virtue of the use of only one fixture, a cost savings can be realized by eliminating the need to manufacture an outlet fixture, and time can be saved by eliminating the need to affix and seal the outlet fixture. While this advantage is particularly beneficial with respect to workpieces which have a surface which is difficult to fixture, as noted above, the cost and time savings would be applicable when machining any workpiece regardless of the ease or difficulty in fixturing surfaces thereof. In addition to the above advantages, the use of a falling abrasive medium, as described above, as compared to a completely enclosed abrasive medium, will reduce the energy requirements in that no energy or force is required to extrude the abrasive medium from the workpiece to the return extrusion chamber. Additionally, the abrasive medium will not be subjected to frictional forces after it exits from the workpiece, which will naturally reduce the extent of wear on the abrasive particles; and further, the unconfined abrasive medium exposed to ambient air will tend to cool considerably during this period of time before it is re-compressed and re-extruded, which will further extend the useful life of the medium and perhaps even eliminate the need for external medium cooling means as is sometimes necessary in conjunction with prior art abrasive flow machining apparatus. Many of these advantages are shared with our invention in our prior patent, U.S. Pat. No. 5,070,652.

In contrast to our prior patent, U.S. Pat. No. 5,070,652, we have gained substantial simplicity and reliability, and a considerable savings in equipment cost in the elimination of the rotary table mechanism. Surprisingly, the time delay required to recharge the extrusion chamber with the flowable medium is quite limited, and when a single cycle is sufficient to fully work the interior passages of the workpiece, it will often be found that the time required to remove the workpiece and to mount another in place will be fully or substantially sufficient to permit the flow of the medium into the extrusion chamber to be completed, so there need be no delay in starting a new cycle.

Figure 3:
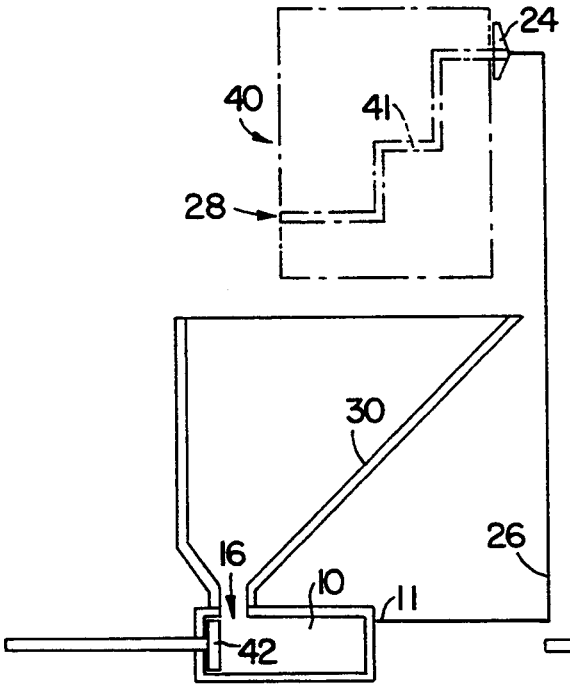
FIG. 3 is a cross section schematic view of an alternate embodiment of the apparatus of the present invention.
Figure 4:
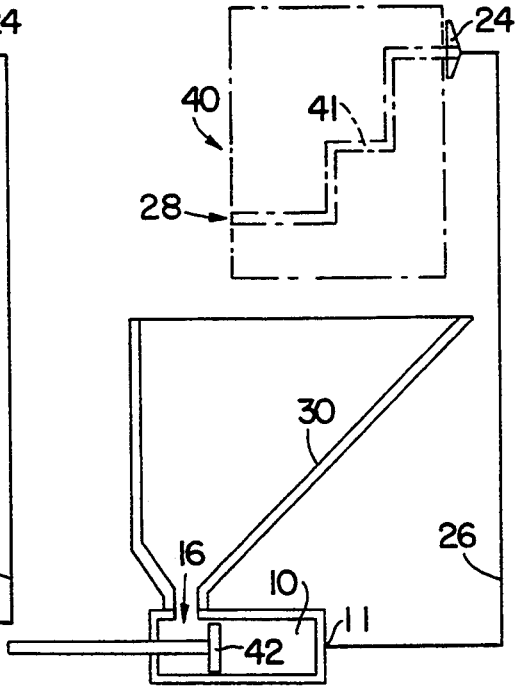
FIG. 4 is a schematic cross section of the embodiment of FIG. 3, in a different stage of operation.
Figure 6:
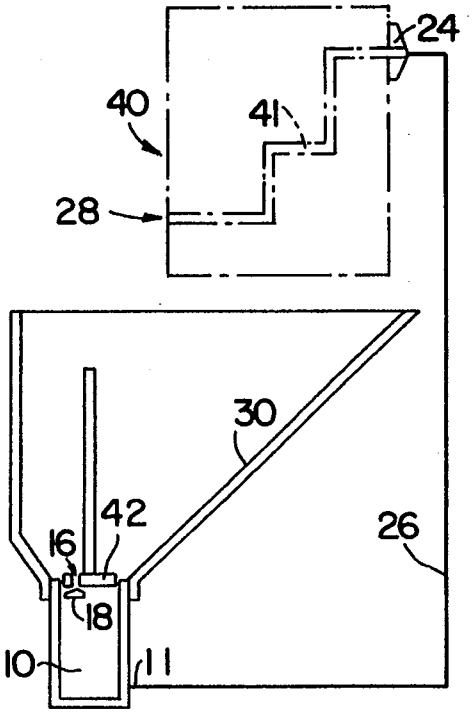
FIG. 6 shows still another embodiment having a port through the face of the piston, and provided with a check valve, also shown in stylized schematic form, which services to open and close the port.
Figure 5:
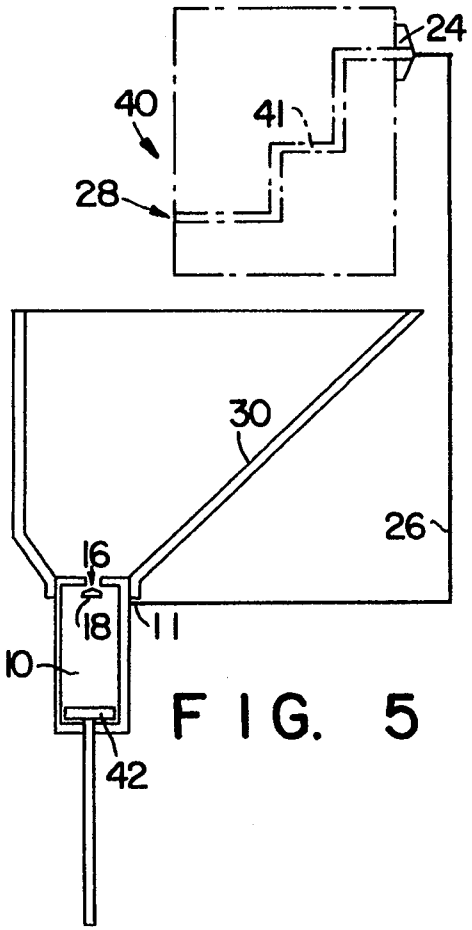
FIG. 5 illustrates another embodiment of the invention, with the piston driven from below. The port in the top of the cylinder is provided with a valve, shown in stylized schematic form, which opens and closes the port.

In FIGS. 3 and 4, an alternate arrangement of the extrusion chamber (10) is illustrated, having a port (16), located through the upper surface of the horizontally disposed cylindrical chamber. The operation and functioning of the parts is otherwise like the embodiment shown in FIG. 1.

The foregoing description and specific embodiments are intended to illustrate the invention to guide those of ordinary skill in the art in the practice of the invention, and are not intended to be limiting on the scope. The full measure of the invention is defined by the following claims, which set out the specific limitations of the invention.

What is claimed is:

1. In an abrasive flow machining and polishing apparatus having a hydraulic actuated reciprocating piston and a extrusion medium chamber adapted to receive and extrude a viscoelastic dispersion of an abrasive unidirectionally across the internal surfaces of a workpiece having an internal passage formed therein, to perform abrasive work on said surfaces, the improvement comprising:

A. fixture means to direct flow of said viscoelastic abrasive dispersion from said hydraulic extrusion medium chamber into at least one inlet of said internal passage;

B. collector means to gravimetrically collect flow of said viscoelastic abrasive dispersion from at least one outlet of said internal passage;

C. a extrusion medium chamber access port adapted to controllably and intermittently open for gravimetric return flow of said viscoelastic abrasive dispersion from said collector means into said hydraulic extrusion medium chamber;

D. said hydraulically actuated piston adapted to extrude said viscoelastic abrasive dispersion from said extrusion medium chamber through said internal passage and into said collector and to intermittently withdraw from extruding position within said extrusion medium chamber to a retracted position to open said extrusion medium chamber access port and to actuate said gravimetric return flow of said viscoelastic abrasive dispersion into said extrusion medium chamber and thereafter advance to close said extrusion medium chamber access port and seal said viscoelastic abrasive dispersion within said extrusion medium chamber.

2. The apparatus of claim 1 wherein said extrusion medium chamber is disposed in a vertical position with said piston driven from above and said extrusion medium chamber port is at least one opening through the extrusion medium chamber wall, disposed above the piston when in extruding position, and below the piston face when said piston is withdrawn to a retracted position.

3. The apparatus of claim 1 wherein said extrusion medium chamber is disposed in a vertical position with said piston driven from above and said extrusion medium chamber port is at least one valved opening through the piston face.

4. The apparatus of claim 1 wherein said extrusion medium chamber is disposed in a vertical position with said piston driven from below and said extrusion medium chamber port is at least one opening through the extrusion medium chamber at the upper end, with a valve to regulate flow of said viscoelastic medium into said extrusion medium chamber wherein said valve is opened by withdrawing said piston from an extruding position to a retracted position.

5. The apparatus of claim 1 wherein said extrusion medium chamber is disposed in a horizontal position and said extrusion medium chamber port is at least one opening through the extrusion medium chamber wall, disposed beyond the piston when in extruding position, and between the piston face and the extrusion medium chamber cavity when said piston is withdrawn to a retracted position.

* * * * *